US009630445B2

(12) United States Patent
Albenda

(10) Patent No.: US 9,630,445 B2
(45) **Date of Patent: *Apr. 25, 2017**

(54) WIPEABLE WRITING SURFACE

(71) Applicant: Abraham R. Albenda, Brooklyn, NY (US)

(72) Inventor: Abraham R. Albenda, Brooklyn, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/151,138

(22) Filed: May 10, 2016

(65) Prior Publication Data

US 2016/0250886 A1 Sep. 1, 2016

Related U.S. Application Data

(63) Continuation of application No. 14/162,412, filed on Jan. 23, 2014, now Pat. No. 9,352,607.

(60) Provisional application No. 61/849,256, filed on Jan. 23, 2013.

(51) Int. Cl.

| | |
|---|---|
| ***B05D 1/28*** | (2006.01) |
| ***B05D 3/12*** | (2006.01) |
| ***B43L 1/00*** | (2006.01) |
| ***B43K 8/02*** | (2006.01) |

(52) U.S. Cl.
CPC ..... *B43L 1/002* (2013.01); *B05D 1/28* (2013.01); *B43K 8/02* (2013.01); *B43L 1/00* (2013.01); *B05D 3/12* (2013.01)

(58) Field of Classification Search
CPC ..... B05D 1/28; B05D 3/12
See application file for complete search history.

(56) References Cited

U.S. PATENT DOCUMENTS 3,354,032 A * 11/1967 Gerlach ..... D21H 5/1254 162/136
4,186,240 A * 1/1980 Matsuda ..... C08L 23/14 428/349
5,116,410 A * 5/1992 Miller ..... C09D 11/16 106/31.58
5,361,164 A * 11/1994 Steliga ..... G03B 21/602 359/455
5,986,224 A * 11/1999 Kent ..... G06F 3/0418 178/18.01
6,153,298 A * 11/2000 Joson ..... B32B 27/08 428/340
6,423,418 B1 * 7/2002 Callicott ..... C08G 18/10 428/458
6,476,965 B1 * 11/2002 He ..... B32B 27/08 359/443
7,495,048 B2 * 2/2009 Van den Bossche ... B32B 27/30 524/187
2004/0020813 A1 * 2/2004 Moeller ..... A45C 11/00 206/425
2006/0214919 A1 * 9/2006 Moore ..... B43L 1/00 345/173
2009/0110920 A1 * 4/2009 Bordener ..... B29C 63/04 428/339

OTHER PUBLICATIONS

Dry Erase Markers on Laminating, http://www.proteacher.net/discussions/showthread.php?t=27867, pp. 1-6, Aug. 24, 2010.*
B. Jordan, Really Good Bulletin Boards, Really Good Stuff, 2010, found at http://www.reallygoodstuff.com/images/art/RealllyGoodStuff_BulletinBoard.pdf.*
GL Catalog, Keeping your best work in the clear, http://web.archive.org/web/20060721085352/http://www.graphiclaminating.com/PDFs/GL_Catalog.pdf; Jul. 21, 2006.*
USI, Lamination Film Finishes, http://web.archive.org/web/20110714030709/http://www.usi-laminate.com/lamination_film_fini.asp, Jul. 14, 2011.*
Vis a Vis Markers, Rainbow Resource Center, located at https://web.archive.org/web/20120122212204/http://rainbowresource.com/product/sku/009438, Jan. 22, 2012.*
Expo FAQs, Expo Markers, https://web.archive.org/web/20111219063512/http://www.expomarkers.com/faq, Dec. 19, 2011.*
Expo Vis a Vis markers product information, OfficeMax, https://web.archive.org/web/20111028073625/http://www.officemax.com/brands/expo/expo-dry-wet-erase-markers/product-ARS25327; Oct. 28, 2011.*
Burfield, Lee, & Smithers, Desiccant Efficiency in Solvent Drying. A Reappraisal by Application of a Novel Method for Solvent Water Assay, J. Org. Chem., vol. 42, No. 18, 1977.*
Word Family Caterpillar Poster Set, Really Good Stuff, pp. 1-9, 2010.*

* cited by examiner

*Primary Examiner* — James M Mellott
(74) *Attorney, Agent, or Firm* — Fay Sharpe LLP

(57) ABSTRACT

Systems and methods provide a user with the ability to mark a surface, easily remove the marking, and remark the same surface. The systems and methods include a marking implement and a mark-receiving surface. When the mark-receiving surface is marked, the resulting mark dries relatively quickly, tends not to smudge, and can be wiped from the surface easily, efficiently and effectively without lasting effect to the mark-receiving surface, which then is available to be marked again.

14 Claims, No Drawings

WIPEABLE WRITING SURFACE

CROSS-REFERENCE TO RELATED APPLICATION

This application claims the benefit of U.S. provisional patent application No. 61/849,256, filed Jan. 23, 2013, which is incorporated herein by reference in its entirety.

BACKGROUND INFORMATION

Articles having surfaces that can be written, wiped clean and rewritten have been made from a variety of materials offering various combinations of properties. Common examples include certain label materials, dry erase articles, note papers, and rewritable tabs for file folders.

Dry erase surfaces are fairly ubiquitous. Glassy or porcelain surfaces have been replaced by melamine or non-porous, hydrophobic coatings, thereby reducing weight. When such surfaces are marked by conventional dry erase markers and then erased after a short time (such as a day or less), they maintain something close to their original condition; however, such markings build adhesion to the surface over time, becoming difficult or even impossible to remove by wiping with a dry eraser, a condition often referred to as ghosting.

Dry erase markers are not as cost effective as their non-dry erase counterparts, and dry erase surfaces remain relatively expensive.

Improved and/or alternative rewritability options continue to be desired. Filing folders with tabs which are marked to identify contents of the folder, hanging file tabs, name tags, notebook covers, drawers, bins, and the like all are examples of surfaces that often require rewriting but which are generally not amenable to use of a dry erase surface. Unfortunately, such surfaces do not accept writing from a satisfactory breadth of writing instruments, do not wipe clean easily, typically tend to degrade when wiped, etc.

A continuing need exists to provide such articles with rewritable surfaces thereon that exhibit improved rewritability. Specifically, rewritable surfaces that are robust, durable, flexible, receptive to being written upon by a variety of marking implements, and easily and fully cleanable for reuse continue to be desirable. Surfaces that include printing markings which complement or assist the marking process by a user are additionally desirable.

SUMMARY

Provided herein are systems and methods that provides a user with the ability to mark a surface, easily remove the marking, and remark the same surface. The systems and methods include a marking implement and a mark-receiving surface. When the mark-receiving surface is marked according to one or more of the methods, the resulting mark dries relatively quickly, tends not to smudge (at least when subjected to normal, incidental-type contact with a digit or fabric), and can be wiped from the surface easily, efficiently and effectively without lasting effect to the mark-receiving surface, which then is available to be marked again.

Users of the systems and methods can mark the mark-receiving surface with inexpensive writing implements, which are not readily removable from most surfaces, yet wipe away the marking(s) as readily as dry erase markings can be removed from a dry erasable surface. Even though the foregoing wiping away can be accomplished with a multitude of moist articles, the marking(s) are not easily smudged and can be essentially permanent unless and until being wiped away.

Advantageously, markings that are left on a mark-receiving surface tend not to leave appreciable ghosting, as described in the preceding section.

Further, mark-receiving surfaces that contact one another tend not transfer markings.

Still further, the mark-receiving surfaces can be prepared in such a way and from such materials that the systems can be provided in a very cost-effective manner. Expensive and heavy dry erase surfaces can be replaced with (or repurposed to be) inexpensive, light and optionally flexible substitutes and, similarly, more expensive dry erase markers can be replaced with less costly and less odiferous alternatives.

DETAILED DESCRIPTION OF ILLUSTRATIVE EMBODIMENTS

The following description is provided to explain and exemplify certain advantages obtainable from systems and methods that employ neither a dry erasable surface nor a dry erase marker. It describes exemplary configurations and methods of operation. The appended claims define the inventions in which exclusive rights are claimed, and they are not to be limited to particular embodiments shown and described.

The systems and methods described below involve two basic components: a marking implement and a mark-receiving surface. The marking implement is described first, followed by an explanation of embodiments and manufacture of the mark-receiving surface.

The marking implement can be any of a variety of pens or markers, subject to two conditions: the marking implement should be non-permanent and need not be of the dry erase type.

Permanent (or indelible) markers are those which yield a marking that cannot be removed readily or easily from most surfaces using an aqueous cleaning composition and/or without damaging the marked surface. A marker can be classified as a permanent marker if it adheres to most surfaces and/or is water resistant. Markings that result from these markers typically are removed by high pressure cleaning or by an organic solvent such as acetone, ethyl acetate, a xylene, benzene, toluene, isopropanol, mineral spirits, many ethers, certain chlorinated hydrocarbons, etc.

The ink in permanent markers includes, in addition to a colorant (e.g., a dye or pigment), one or more carrying solvents, one or more polymers (typically acrylic-type polymers), a fatty acid ester of glycerol (i.e., glyceride), and a coalescent; as the carrying solvent(s) evaporate, the ink dries into a colored film that is water insoluble.

Some well known brands of permanent markers include SANFORD™ and SHARPIE™. These and other permanent markers are not employed in the inventive systems or methods because they cannot be wiped away from the mark-receiving surface quickly, easily and without leaving smudges and/or damaging the mark-receiving surface.

The systems and methods described herein advantageously do not require dry erase markers. These markers contain many of the same ingredients as permanent markers, with a primary difference being in the type of polymer(s) employed in the ink: dry erase markers typically employing a release-type polymer such as a silicone, which prevents the colorant from completely adhering to and absorbing into the marked surface. The solvents employed in dry erase markers must evaporate after marking, which is the source of the characteristic odor of these markers when in use.

Non-limiting examples of potentially useful non-permanent marking implements include washable markers, wet erase markers such as EXPO™ Vis-à-Vis™, gel pens and markers, and even ballpoint and roller ball-type pens. Those implements that have a non-metallic, relatively soft, fabric or filament tip (i.e., a marker) are preferred over metallic tipped implements because they are less likely to gouge, scratch or otherwise damage the mark-receiving surface.

A common characteristic of the foregoing exemplary marking implements is that their inks either do not contain a polymeric material (e.g., wet erase markers) or contain only water soluble polymers, gels or pastes.

Among the various options, those that employ (liquid) dyes rather than (suspended solid) pigments can be preferred in some situations.

Additionally, those that have no or little odor are generally preferable, particularly in an educational or other closed space setting (e.g., office).

Potentially useful marking implements are sold under a variety of consumer brands, including such well known names as CRAYOLA™, DRI-MARK™, PILOT™, STA-BIL™, FOOHY™, etc.

The mark-receiving surface is or includes a layer of a hydrophobic polymer that includes units from one or more hydrocarbon monomers.

The mark-receiving surface can be created in place or can be manufactured and delivered in ready-to-use form.

A create-in-place surface can be provided by coating an existing surface, such as a wall or a desktop, with an appropriate hydrophobic polymer coating. The polymeric coating can be applied by brush, roller, spray, blotch or any of a variety of other methods. The polymer can be provided in the form of a solution, suspension, emulsion, dispersion, etc., and can form an essentially unitary, continuous film upon evaporation of the carrying liquid(s) and coalescence.

Ready-to-use products can take a variety of forms and employ a number of materials. A few non-limiting examples are provided below, the description of which is sufficient to permit the ordinarily skilled artisan to envision scores of other potentially useful constructions and materials.

A mark-receiving surface has at least one exterior primary surface that is, or that consists essentially of, a hydrophobic polymer, preferably one that includes hydrocarbon mer and specifically one that includes mer derived from one or more $C_2$-$C_8$ α-olefins. Highly preferred coatings are those that include a significant portion (e.g., at least 50%, preferably at least 65%, more preferably at least 75%, and most preferably at least 85%) of $C_2$ and/or $C_3$ olefinic mer. Most preferred polymers employed or constituting a hydrophobic are LDPE and polypropylene, although other polyethylenes (e.g., HDPE, LLDPE, etc.) work well in many embodiments.

Non-hydrocarbon polymers such as acrylates, urethanes, MF and UF resins, etc., can be employed, although these tend to be more costly than the hydrocarbon polymers described above.

The thickness of the coating is not as important to utility as is uniformity. In other words, very thin layers of a hydrophobic coating can provide the desired rewritable exterior surface. In most circumstances, the coating that provides the rewritable surface has a thickness that is less than ~500 μm, ~400 μm, ~300 μm, ~250 μm, ~200 μm, ~150 μm, ~125 μm, ~100 μm, ~75 μm, ~50 μm or even ~25 μm. In some embodiments, the rewritable surface has a thickness that is no more than 10 μm, no more than 9 μm, no more than 8 μm, no more than 7 μm, no more than 6 μm, no more than 5 μm, no more than 4 μm, no more than 3 μm, no more than 2 μm, and no more than 1 μm.

The minimum thickness of the coating typically is a function of such characteristics as desired durability and intended lifespan. Generally, thicker coatings provide longer life and can withstand a higher number and more aggressive cleanings. In most cases, the coating is not less than ~0.1 μm, ~0.2 μm, ~0.3 μm, ~0.4 μm, ~0.5 μm, ~0.6 μm, ~0.7 μm, ~0.8 μm, ~0.9 μm, or 1 μm.

Values from the preceding two paragraphs can be combined to provide potential ranges of coating thicknesses.

The hydrophobic coating can be transparent, translucent or opaque, with optical properties typically determined by intended end use. Opacity can be created or increased by incorporation of pigments such as, but not limited to, titanium dioxide, calcium carbonate, hollow particle pigments, and the like. Where desired, the pigment also can provide a tint to the coating, or one or more colorants can be added to the resins from which the coating is provided.

The coating also can include optional additives such as drying aids, matting agents, antioxidants, antimicrobials, inorganic fillers, and the like. Any such additive employed preferably does not interfere with the coating's ability to receive and to release markings applied by the aforedescribed marking implement.

The gloss level of the hydrophobic coating can vary from matte to glossy, again depending primarily on intended end use. Matte surfaces typically permit faster drying of markings on the surface, while glossy surfaces typically are easier to wipe clean.

The hydrophobic coating can be smooth or have a tactile feel (i.e., texture), again depending on intended end use. Regardless of the relative smoothness, however, the coating preferably is essentially continuous, i.e., free of the types of holes, gaps, voids, etc., that might permit ink to reach the underlying substrate.

Although certainly not required, the hydrophobic coating can be a multilayer structure. For example, a coating can include multiple layers, the outermost of which is or includes the hydrophobic polymer that will receive the marking(s) and wiped clean.

Additionally or alternatively, the coating itself can be printed, which can be done alternatively or in addition to the substrate printing described below. Printed coatings can be particularly useful for the educational and recreational utilities described below.

The hydrophobic coating typically is carried on a substrate such as plastic, wood, metal, paper, paperboard, card stock, cardboard, corkboard, woven or non-woven textile, and the like. In many instances, the substrate will be made of materials that include plant based fibers such as cotton and/or cellulose.

To increase the compatibility of the coating to the substrate, one or more primer coatings can be applied to the primary surface of the substrate that is to receive the hydrophobic coating.

Additionally, where the substrate does not have significant structural integrity and/or tensile strength, it can include a reinforcement or backing on a primary surface opposite that of the surface to receive the hydrophobic coating.

For cost, weight, availability and renewability considerations, preferred substrates include paper, paperboard, card stock and cardboard.

The substrate can be transparent, translucent, opalescent, opaque, patterned, etc. In some embodiments, the substrate can include a marking that is intended to be reproduced on the hydrophobic coating by a user. For example, a child learning his or her letters and/or numbers might benefit from an article that includes templates for those characters printed on or in the substrate (or coating), over which the child can trace.

In embodiments where the substrate is transparent, it can be provided in a construction that permits it to be partially or fully removed from a secondary substrate that acts to support it. For example, a relatively thick substrate can have one or more overlay sheets fixedly or removably attached at one edge. After a user marks an overlay sheet in a desired manner, a removably attached sheet can be torn or sheared away from the secondary substrate and displayed, turned in to an instructor for evaluation, exchanged with a friend, etc. (In such embodiments, the secondary substrate can include one or more markings that are intended to be reproduced, as described in the preceding paragraph.)

Where paper is used as a substrate, it can be of essentially any basis weight and can be coated or uncoated. (The preceding refers to paper grade. The previously described hydrophobic coating is applied regardless of whether the substrate is coated paper or uncoated paper.)

Individual writable sheets can be bound together in the form of a book or easel pad. Sheets can include perforations so that individual sheets can be removed from the binding.

Another possible construction is the type of multi-panel display described in U.S. Pat. No. 7,823,309, the disclosure of which is incorporated herein by reference. By providing the show side of the panels of such a display with an appropriate hydrophobic coating, those panels can be marked with information relating to one project, wiped clean after the project is complete, and be ready for use in a subsequent project.

Once a user marks the hydrophobic coating of an article, the marking is essentially permanent until removed. In other words, once initial drying occurs, the marking does not smear, smudge, run or fade quickly or easily.

Removal of markings occurs by application of a gentle solvent, preferably water or an aqueous composition such as rubbing alcohol or hard surface cleaner. The solvent can be carried in an article such as a non-woven wipe, can be applied to an article such as a rag or paper towel, or can be applied directly to (e.g., misted or sprayed on) the marked coating. Depending on the ink employed, the moisture present in human skin is sufficient to achieve removal of markings.

Once wiped, the exterior surface of the hydrophobic coating typically, and advantageously, displays no ghosting and/or discoloration.

The aforedescribed components can be provided in the form of a kit that includes an article that includes a mark-receiving surface, one or more marking implements, and optionally a mark-removing article (e.g., one or more reusable wipes). A user then can employ the components of the kit to perform a method of the present invention.

In another embodiment, a kit can include an article that includes a coating composition of the type described above and optionally one or more implements for applying the coating composition to a surface of the user's choice, e.g., a wall, corkboard, whiteboard, chalkboard, etc. This type of kit can provide a user with an opportunity to repurpose an existing substrate into a mark-receiving surface of the type described above. This type of kit optionally can include a mark-removing article (e.g., one or more reusable wipes) and/or one or more marking implements.

The inventive methods and systems can find particular utility in educational activities such as, for example, mathematical exercises, handwriting practice, creation and study of maps, spelling exercises, and the like, all of which can be provided in book form which, of course, can be reused, thereby saving significant amounts of money for school districts, and recreational activities such as word finds, anagrams, Sudoku puzzles, crossword puzzles, drawing and sketching, and the like.

The foregoing description has employed certain terms and phrases for the sake of brevity, clarity, and ease of understanding; no unnecessary limitations are to be implied therefrom because such terms are used for descriptive purposes and are intended to be broadly construed.

The foregoing configurations and methods have been presented by way of example only. Certain features of the described configurations and methods may have been described in connection with only one or a few such configurations or methods, but they should be considered as being useful in other such configurations or methods unless their structure or use is incapable of adaptation for such additional use. Also contemplated are combinations of features described in isolation.

What is claimed is:

1. A method for removably marking a surface of an article, comprising a) providing an article having at least one area configured for receiving markings on a surface;

b) providing a surface coating on said at least one area of said article, said coating comprising a low density polyethylene;

c) marking said coating with a non-permanent, non-dry erase marker, wherein said marking resists smudging after drying; and d) wiping said marking from said coating with a water-containing article, thereby providing an unmarked surface free of ghosting that is available for being marked again.

2. The method of claim 1 wherein said coating consists of LDPE.

3. The method of claim 1 wherein said coating includes a drying agent.

4. The method of claim 1 wherein said article comprises a plurality of sheets.

5. The method of claim 1 wherein said marker is washable.

6. The method of claim 1 wherein said substrate is rigid.

7. The method of claim 1 wherein said substrate includes indicia between said substrate and said coating.

8. A method for removably marking a surface, comprising a) providing an article including a surface having permanent indicia thereon;

b) providing a low density polyethylene coating over at least said surface having said permanent indicia;

c) marking said coating with a non-permanent, non-dry erase marker, wherein said marking resists smudging after drying; and d) wiping said marking from said coating with a water-containing article, thereby providing an unmarked coating free of ghosting that is available for being marked again.

9. The method of claim 8 wherein said coating consists of low density polyethylene.

10. The method of claim 8 wherein said article is flexible.

11. The method of claim 8 wherein said article is rigid.

12. The method of claim 8 wherein said article is transparent.

13. The method of claim 8 wherein said coating is opaque.

14. The method of claim 8 wherein said marker is washable.

* * * * *